US010865358B2

(12) United States Patent
Hua et al.

(10) Patent No.: US 10,865,358 B2
(45) Date of Patent: Dec. 15, 2020

(54) SOOT DISPERSANT

(71) Applicant: Jinzhou DPF-TH Chemicals Co., Ltd., Jinzhou (CN)

(72) Inventors: Jun Hua, Jinzhou (CN); Yantao Zhu, Jinzhou (CN); Xiao Wei, Jinzhou (CN); Rolfe Hartley, Jinzhou (CN); Ricardo Bloch, Jinzhou (CN); Yuan Gao, Jinzhou (CN)

(73) Assignee: Jinzhou DPF-TH Chemicals Co., Ltd., Jinzhou (CN)

( * ) Notice: Subject to any disclaimer, the term of this patent is extended or adjusted under 35 U.S.C. 154(b) by 0 days.

(21) Appl. No.: 16/256,050

(22) Filed: Jan. 24, 2019

(65) Prior Publication Data

US 2019/0300812 A1 Oct. 3, 2019

(30) Foreign Application Priority Data

Mar. 30, 2018 (CN) ..... 2018 1 0290906

(51) Int. Cl.

| | |
|---|---|
| ***C10M 149/06*** | (2006.01) |
| ***C10M 159/22*** | (2006.01) |
| ***C10M 159/24*** | (2006.01) |
| ***C10M 133/06*** | (2006.01) |
| ***C10M 145/26*** | (2006.01) |
| ***C10M 129/42*** | (2006.01) |
| *C10N 10/12* | (2006.01) |
| *C10N 10/14* | (2006.01) |
| *C10N 30/02* | (2006.01) |
| *C10N 30/04* | (2006.01) |
| *C10N 40/25* | (2006.01) |

(52) U.S. Cl.

CPC ..... *C10M 149/06* (2013.01); *C10M 129/42* (2013.01); *C10M 133/06* (2013.01); *C10M 145/26* (2013.01); *C10M 159/22* (2013.01); *C10M 159/24* (2013.01); *C10M 2201/06* (2013.01); *C10M 2207/028* (2013.01); *C10M 2209/102* (2013.01); *C10M 2215/064* (2013.01); *C10M 2217/042* (2013.01); *C10N 2010/12* (2013.01); *C10N 2010/14* (2013.01); *C10N 2030/02* (2013.01); *C10N 2030/04* (2013.01); *C10N 2040/252* (2020.05)

(58) Field of Classification Search

CPC ..... C10M 149/06; C10M 129/42; C10M 145/26; C10M 133/06; C10M 159/24; C10M 159/22; C10M 2207/028; C10M 2215/064; C10M 2209/102; C10M 2217/042; C10M 2201/06; C10M 2223/045; C10M 2219/046; C10M 2207/262; C10M 2227/066; C10M 2207/026; C10M 2215/28; C10M 149/14; C10N 2210/07; C10N 2210/06; C10N 2230/04; C10N 2240/102; C10N 2230/02; C10N 2210/02; C10N 2230/041; C10N 2220/022; C10N 2220/021; C10N 2230/52

See application file for complete search history.

(56) References Cited

U.S. PATENT DOCUMENTS

| | | | | |
|---|---|---|---|---|
| 6,458,172 | B1 * | 10/2002 | Macduff | C10L 1/143 44/348 |
| 2003/0195128 | A1 * | 10/2003 | Deckman | C10M 111/04 508/591 |
| 2008/0248980 | A1 * | 10/2008 | Sumiejski | C10M 169/045 508/156 |
| 2017/0073606 | A1 * | 3/2017 | Galic Raguz | C10M 149/12 |

* cited by examiner

*Primary Examiner* — Taiwo Oladapo
(74) *Attorney, Agent, or Firm* — Clark & Elbing LLP

(57) ABSTRACT

The present invention is directed to a use of a lubricant in a diesel engine to disperse soot produced by the diesel engine, the soot being dispersed without adversely affecting the viscosity of the lubricant; the lubricant comprising a major amount of oil of lubricating viscosity and a minor amount of a dispersant comprising (i) one or more olefin, (ii) one or more carboxylic acid, (iii) one or more polyetheramines and (iv) one or more aromatic amines along with co-additives.

19 Claims, No Drawings

SOOT DISPERSANT

RELATED APPLICATION

This application is a continuation of Chinese Patent Application No. 201810290906.X, filed Mar. 30, 2018, which is incorporated by reference in its entirety.

FIELD OF THE INVENTION

The disclosure relates to a novel formulation for improving the soot or sludge handling characteristics in a lubricating formulation.

BACKGROUND OF THE INVENTION

All internal combustion engines produce soot as a result of incomplete fuel combustion. However, because of the way that fuel is injected and ignited, soot formation occurs more commonly in diesels than in gasoline engines.

With gasoline engines, the fuel/air mixture is injected during the intake stroke and ignited with a spark, in diesels; the fuel/air mixture is injected during the compression stroke and ignited spontaneously from the high pressure in the combustion chamber.

The less air that is present, the more favourable the conditions for soot accumulation, combustion is more efficient in gasoline engines because the air and fuel have a chance to more thoroughly mix than it typically does in diesel engines.

When fuel is combusted in the engine, some of the diesel fuel cannot completely combine with oxygen and that leaves behind small unburned particles of carbon, these small carbon particles accumulate in the crankcase oil as the engine piston reciprocates during the engine cycle.

Over time, soot will build up in the oil and may lead to problems. The soot that accumulates in the oil cannot be eliminated by the oil or completely trapped by the oil filter so keeping the soot under control is the challenge.

Engines that have improper fuel combustion or have malfunctioning fuel injectors can cause additional build-up of soot. Also, operating conditions, such as excessive engine idling or lugging the engine, can increase the level of soot.

The overall result of these factors is reduced combustion efficiency resulting in higher levels of soot particles forming in the engine oil.

In most modern well-maintained diesel engines, the majority of soot will be oxidized within the combustion chamber or later trapped and oxidized downstream in the emissions system, however, some soot escapes and gets past the piston rings and ends up in the crankcase oil and soot loading in diesel engine oil can present wear problems.

As the piston goes down for every power stroke, soot can accumulate on the cylinder liners of each bore and can be scraped down by the oil control piston rings. Soot can be further delivered to the crankcase via blow-by of combustion gases past the piston rings, especially if they are worn.

Additionally, the thin motor oil film retained on the bores can partially break down under combustion heat, leaving more soot.

High soot levels in the oil can cause a loss of dispersant additives and ultimately form what is known as sludge. As the dispersants become depleted, the soot particles clump together and attach themselves to engine surfaces. This leads to reduced lubrication due to impeded oil flow through the engine. Particle clumps can also form on oil filters, blocking oil flow and allowing dirty oil into the engine.

The tendency for soot particles to aggregate or join together is called agglomeration. Soot agglomeration increases when the oil can no longer handle or disperse the level of soot load in the oil.

Soot particles are very small in size and generally pass through the filter media until they begin to agglomerate. At this state, the oil condition can cause several problems.

The accumulation of excessive soot leads to oil thickening which can cause poor oil flow during engine start up and reduce lubrication.

As soot accumulates and begins to agglomerate, the oil filter will collect more soot and eventually reach filtration capacity. Once the oil filter has reached capacity, the engine demands oil either filtered or unfiltered.

Soot is carbon, and as carbon agglomerates and accumulates it becomes more abrasive. Equipment maintainers who perform oil analysis can see the result of the increased soot loading in several ways. When the percentage of soot in the oil increases, this can result in an oil viscosity increase. If allowed to accumulate to higher levels, the engine wear metals will also increase.

As oil increases in viscosity due to higher levels of soot loading, there is a tendency for the greater amounts of the thickened oil to accumulate on the engine cylinder wall. As the engine piston moves upward, the increased accumulation of soot laden oil on the cylinder wall may result in the excess oil being released into the combustion process. This condition can result in increased oil consumption.

Soot is formed in fuel-rich, cool regions of the combustion chamber and impinges on the cylinder wall, where it is scraped into the engine oil sump by the piston rings. Upon entering the engine oil sump, the soot is rapidly mixed in with the bulk oil and circulates throughout the engine. As oil passes through the engine gears, the soot particles are ground into extremely fine particles, nominally 1000 Angstroms, and are maintained in suspension by the lubricant dispersants.

The soot will remain homogeneously suspended in the oil, until the soot concentration reaches a level great enough that it precipitates out of the oil. This may also result in filter plugging. Oil formulations which have high dispersancy levels will keep the soot in suspension to higher concentration levels.

Soot is a non-classical abrasive. It will erode boundary lubricated surfaces at high concentrations. This will cause severe engine wear. Some symptoms of soot induced wear include tappet polishing, cam lobe wear, rocker/crosshead wear and ring wear at top.

The present invention, therefore, solves the problem of soot related increases in lubricant viscosity by providing improved soot dispersion and toleration properties, particularly in diesel engines, and especially in heavy duty diesel engines.

Reference can be made to US Patent Application 2010160193 which discloses about An oil-soluble lubricating oil additive composition prepared by the process which comprises (A) reacting a copolymer of an (i) an unsaturated acidic reagent; and (ii) a mono-olefin, with at least one linking hydrocarbyl di-primary amine, thereby producing a hybrid succinic anhydride copolymer having from about 10% to about 90% unreacted anhydride groups; and subsequently (B) reacting the hybrid succinic anhydride copolymer with a second amine compound, thereby producing the succinimide.

Reference can be made to US Patent Application 2013040866 which discloses an engine lubricant composition, a method for maintaining the soot or sludge handling capability of an engine lubricant while not adversely affecting elastomeric seal material in the engine and a method of operating an engine. The engine lubricant includes base oil and a dispersant. The dispersant is a reaction product of A) a hydrocarbyl-dicarboxylic acid or anhydride, B) a polyamine, C) a dicarboxyl-containing fused aromatic compound, and D) a non-aromatic dicarboxylic acid or anhydride.

Reference can be made to US Patent Application 2007049503 which discloses about a lubricating oil additive composition, a lubricating oil composition, and methods of making the same. More particularly the present invention is directed to such a lubricating oil additive and a lubricating oil composition which are suitable as engine oil and highly effective in dispersing soot in an engine.

Reference can be made to US Patent Application 2012234287 which discloses about a crankcase lubricant composition, method for improving the soot or sludge handling capability of a crankcase lubricant composition and a method of operating an engine on a crankcase lubricant composition. The lubricant composition includes base oil and a reaction product of mono-succinimide dispersant and an acidic compound containing two or more pyrrole groups.

Reference can be made to U.S. Pat. No. 7,485,603 which discloses about a novel class of linked aromatic compounds that act as potent soot dispersants in lubricating oil compositions and lubricating oil compositions containing same. More specifically, the invention is directed to compounds that, when added to lubricating oil compositions provide soot dispersing performance in the industry standard "Mack T11" engine test, with reduced levels of additive nitrogen.

Reference can be made to US Patent Application 2010130393 which discloses about a carboxylic acid-containing polymer with certain aromatic amines and polyols results in ester containing dispersant viscosity modifiers with improved soot handling performance in heavy-duty diesel engines, compared with non-ester containing dispersants.

NEED OF THE INVENTION

Dispersing the soot particles and preventing the natural tendency for the soot particles to join together and prevent several lubrication related problems.

To overcome the above shortcomings it was required to develop a formulation which improves the soot dispersancy.

OBJECTIVE OF THE INVENTION

The principal object of the present invention is to provide a formulation package which enhances the soot dispersancy.

Another objective of the present invention is to achieve chain extension to impart significant viscosity increase.

Another objective of the present invention is to reduce the process of agglomeration.

Another objective of the present invention is to provide protection against engine wear.

Yet another objective of the present invention is to reduce the oil consumption.

SUMMARY OF THE INVENTION

The present invention comprises a novel formulation of chain extended succinimides and amides based on Polyisobutylene succinic anhydride increasing the property of soot dispersancy comprising; (a) an alkenyl-substituted succinic anhydride, (b) a polyamine compound and (C) Co-additives.

DETAILED DESCRIPTION OF THE PRESENT INVENTION

Various preferred features and embodiments will be described below by way of non-limiting illustration.

Succinimide Dispersants—

Suitable acylating agents include hydrocarbyl carbonic acid, hydrocarbyl carbonic acid halides, hydrocarbyl sulfonic acid and hydrocarbyl sulfonic acid halides, hydrocarbyl phosphoric acid and hydrocarbyl phosphoric halides, hydrocarbyl isocyanates and hydrocarbyl succinic acylating agents. Preferred acylating agents include polyacylating agent's which provide bis ester, ester acid and/or ester lactone substituent groups. Preferred acylating agents are C8 and higher hydrocarbyl isocyanates, such as dodecyl isocyanate and hexadodecyl isocyanate and C8 or higher hydrocarbyl acylating agents, more preferably polybutenyl succinic acylating agents such as polybutenyl, or polyisobutenyl succinic anhydride (PIBSA). Preferably the hydrocarbyl succinic acylating agent will be derived from polyalkene having a number average molecular weight (Mn) of from about 100 to 5000, preferably from about 200 to about 3000, more preferably from about 500 to about 2500. Acylating agents can be prepared by conventional methods known to those skilled in the art, such as chlorine-assisted, thermal and radical grafting methods. The acylating agents can be mono- or polyfunctional. Preferably, the acylating agents have functionality in the range of 1-2.5.

Carboxylic Acid—

The acid may be a monoacid, a dimer acid, or a trimer acid. The acid may be selected from the group consisting of formic acid, acetic acid, propionic acid, butyric acid, caprylic acid, capric acid, lauric acid, myristic acid, palmitic acid, stearic, arachidic acid, behenic acid, lignoceric acid, cerotic acid, myristoleic acid, palmitoleic acid, sapienic acid, oleic acid, elaidic acid, vaccenic acid, linoleic acid, linoelaidic acid, .alpha.-linolenic acid, arachidonic acid, eicosapentaenoic acid, erucic acid, docosahexaenoic acid, and the dimer and trimer acids thereof.

The method of preparing dimeric fatty acids or esters thereof initially involves dimerizing monomeric unsaturated fatty acids and/or esters thereof to provide a first mixture containing dimeric fatty acids and/or esters thereof, unreacted monomeric fatty acids and/or rearranged monomeric fatty acids and/or esters thereof and interesters, suitable examples include iso-octanedioic acid, octanedioic acid, nonanedioic acid (azelaic acid), decanedioic acid (sebacic acid), undecanedioic acid, dodecanedioic acid, tridecanedioic acid, tetradecanedioic acid, pentadecanoic acid or mixtures thereof. In one embodiment the polycarboxylic acid is nonanedioic acid (azelaic acid) or mixtures thereof. In one embodiment the polycarboxylic acid is adpic acid, decanedioic acid (sebacic acid) or mixtures thereof.

Polyetheramines—

Polyetheramines can be amine-terminated polyethers such as polyethylene oxide (PEO), polypropylene oxide (PPO) or combination of PEO/PPO copolymers. For example, some of the commercial polyethers include: poly (ethyleneglycol) bis(3-aminopropylether) (34901-14-9, mw 1500), poly(propyleneglycol) bis(2-aminopropylether) (mw 230), poly(propyleneglycol) bis(2-aminopropylether) (mw 400), poly(propyleneglycol) bis(2-aminopropylether) (9046-10-0, mw 2000), poly(propyleneglycol) bis(2-aminopropylether) (mw 4000), poly(propyleneglycol)-block-poly (ethyleneglycol)-block poly(propyleneglycol) bis(2-aminopropylether) (65605-36-9) (3.5:8.5) (PO:EO) (mw 600), poly(propyleneglycol)-block-poly(ethyleneglycol)-block poly(propyleneglycol) bis(2-aminopropylether) (3.5:15.5) (PO:EO) (mw 900), poly(propyleneglycol)-block-poly(ethyleneglycol)-block poly(propyleneglycol) bis(2-aminopropylether) (3.5:40.5) (PO:EO) (mw 2000), glycerol tris[poly (propylene glycol), amine terminated] ether (64852-22-8, mw 3000 or mw 440), Trimethylolpropane tris[poly(propylene glycol), amine terminated] ether (39423-51-3, mw 440) poly(tetrahydrofuran), bis(3-aminopropyl) terminated (72088-96-1), and the like.

Amines—

Amines which may be employed in the present invention include any that have at least one primary amino group which can react to form an imide group and at least one additional primary or secondary amino group and/or at least one hydroxyl group.

Suitable amines may include alkylene polyamines, such as propylene diamine, dipropylene triamine, di-(1,2-butylene)triamine, and tetra-(1,2-propylene)pentamine. A further example includes the ethylene polyamines which can be depicted by the formula H2N(CH2CH2NH)nH, wherein n may be an integer from about one to about ten. These include: ethylene diamine, diethylene triamine (DETA), triethylene tetramine (TETA), tetraethylene pentamine (TEPA), pentaethylene hexamine (PEHA), Heavy polyamine (HPA) and the like, including mixtures thereof.

Polyamines that are also suitable in preparing the dispersants described herein include N-arylphenylenediamines, such as N-phenylphenylenediamines, for example, N-phenyl-1,4-phenylenediamine, N-phenyl-1,3-phenylendiamine, and N-phenyl-1,2-phenylenediamine; aminothiazoles such as aminothiazole, aminobenzothiazole, aminobenzothiadiazole and aminoalkylthiazole; aminocarbazoles; aminoindoles; aminopyrroles; amino-indazolinonesi; aminomercaptotriazoles; aminoperimidines; aminoalkyl imidazoles, such as 1-(2-aminoethyl) imidazole, 1-(3-aminopropyl) imidazole; and aminoalkyl morpholines, such as 4-(3-aminopropyl) morpholine.

Hydroxyamines suitable for herein include compounds, oligomers or polymers containing at least one primary or secondary amine capable of reacting with the hydrocarbyl-substituted succinic acid or anhydride. Examples of hydroxyamines suitable for use herein include aminoethylethanolamine (AEEA), aminopropyldiethanolamine (APDEA), dimethylaminopropylamine (DMAPA), ethanolamine, diethanolamine (DEA), partially propoxylated hexamethylene diamine (for example HMDA-2PO or HMDA-3PO), 3-amino-1,2-propanediol, tris(hydroxymethyl)aminomethane, and 2-amino-1,3-propanediol.

Co-Additives—

The lubricating composition optionally contains at least one other performance additive. Typically the other performance additives include metal deactivators, defoamers, dispersant, antioxidants, antiwear agents, corrosion inhibitors, antiscuffing agents, extreme pressure agents, foam inhibitors, demulsifiers, friction modifiers, viscosity modifiers, pour point depressants and mixtures thereof. Typically, fully-formulated lubricating oil will contain one or more of these performance additives.

Base Oils—

The term "Group I base oil" as used herein refers to a petroleum derived lubricating base oil having a saturates content of less than 90 wt. % (as determined by ASTM D 2007) and/or a total sulfur content of greater than 300 ppm (as determined by ASTM D 2622, ASTM D 4294, ASTM D 4297 or ASTM D 3120) and has a viscosity index (VI) of greater than or equal to 80 and less than 120 (as determined by ASTM D 2270).

In general, a Group II base oil and Group III base oil can be any petroleum derived base oil of lubricating viscosity as defined in API Publication 1509, 14th Edition, Addendum 1, December 1998. API guidelines define a base stock as a lubricant component that may be manufactured using a variety of different processes. Group II base oils generally refer to a petroleum derived lubricating base oil having a total sulfur content equal to or less than 300 parts per million (ppm) (as determined by ASTM D 2622, ASTM D 4294, ASTM D 4927 or ASTM D 3120), a saturates content equal to or greater than 90 weight percent (as determined by ASTM D 2007), and a viscosity index (VI) of between 80 and 120 (as determined by ASTM D 2270). Group III base oils generally have less than 300 ppm sulfur, saturates content greater than 90 weight percent, and a VI of 120 or greater. In one embodiment, the Group III base stock contains at least about 95% by weight saturated hydrocarbons. In another embodiment, the Group III base stock contains at least about 99% by weight saturated hydrocarbons.

Metal Detergent—

The detergents include but are not limited to overbased sulfonates, phenates, salicylates and the like overbased detergents known in the art. Overbased materials otherwise referred to as overbased or superbased salts are generally single phase, homogeneous systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, typically carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol.

Overbased sulphonates typically have a TBN of 200 to 600 mg KOH/gm, or 300 to 500. The metal sulphonate detergent may be an alkaline earth metal or alkali metal sulphonate. For example the metal may be sodium, calcium, barium, or magnesium. Typically other detergent may be sodium, calcium, or magnesium containing detergent (typically, calcium, or magnesium containing detergent). In one embodiment the metal may be calcium.

Friction Modifier—

Friction modifiers that are compatible with the other ingredients of the final oil may also be included. Examples of such materials include oil-soluble organo-molybdenum compounds, such oil soluble organo-molybdenum compounds include dithiocarbamates, dithiophosphates, dithiophosphinates, xanthates, thioxanthates, sulfides, and the like, and mixtures thereof.

Particularly preferred are molybdenum dithiocarbamates, Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, MoOCl4, MoO2Br2, Mo2O3Cl6, molybdenum trioxide or similar acidic molybdenum compounds.

Antiwear—

ZDDP is conventionally added to lubricating oil compositions in amounts of 0.1 to 10, preferably 0.2 to 2 wt. %, based upon the total weight of the lubricating oil composition. They may be prepared in accordance with known techniques. The preferred zinc dihydrocarbyl dithiophosphates are oil soluble salts of dihydrocarbyl dithiophosphoric acids and may be represented by the following formula:

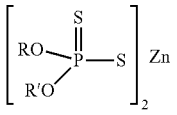

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, thexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

Antioxidants—

Antioxidants or oxidation inhibitors are used to minimize the effect of oil deterioration that occurs when hot oil is contacted with air. The degree and rate of oxidation will depend on temperature, air and oil flow rates and, of particular importance, on the presence of metals that may catalytically promote oxidation. Antioxidants generally function by prevention of peroxide chain reaction and/or metal catalyst deactivation. They prevent the formation of acid sludges, darkening of the oil and increases in viscosity due to the formation of polymeric materials.

Non-limiting examples of suitable oxidation resistance (antioxidant) and thermal stability improvers are diphenly-, dinaphtyl-, and phenyl-naphthyl-amines, in which the phenyl and naphthyl groups can be substituted, for example, N,N'-diphenyl phenylenediamine, p-octyldiphenylamine, p-dioctyldiphenylamine, alkylated diphenylamine, alkylated phenyl alpha naphthylamine, N-phenyl-1-naphthyl amine, N-phenyl-2-naphthyl amine, N-(p-dodecyl)-phenyl-2-naphthyl amine, di-1-naphthylamine, and di-2-naphthylamine; phenothazines such as N-alkylphenothiazines; imino(-bis-benzyl); hindered phenols such as 6-(t-butyl)phenol, 2,6-di-(t-butyl)phenol, 4-methyl-2, 6-di-(t-butyl)phenol, 4,4'-methylenebis(−2,6-di-{t-butyl}-phenol), esters of 3,5-di-tert-butyl-4-hydroxyhydrocinnamic acid, thiodiethylene bis-(3,5-di-tert-butyl-4-hydroxy) hydrocinnamate, esters of [[[3,5-bis(1,1-dimethylethyl)-4-hydroxyphenyl]methyl]thio]acetic acid and the like.

Viscosity Modifiers—

Viscosity modifiers that are compatible with the other ingredients of the final oil may also be included. Non-limiting examples of suitable viscosity index improvers include, but are not limited to, olefin copolymers, such as ethylene-propylene copolymers, styrene-isoprene copolymers, hydrated styrene-isoprene copolymers, polybutene, polyisobutylene, polymethacrylates, vinylpyrrolidone and methacrylate copolymers and dispersant type viscosity index improvers. These viscosity modifiers can optionally be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers). Other examples of viscosity modifiers include star polymers (e.g., a star polymer comprising isoprene/styrene/isoprene triblock). Yet other examples of viscosity modifiers include poly alkyl(meth)acrylates of low Brookfield viscosity and high shear stability, functionalized poly alkyl(meth)acrylates with dispersant properties of high Brookfield viscosity and high shear stability, polyisobutylene having a weight average molecular weight ranging from 700 to 2,500 Daltons and mixtures thereof.

TABLE 1

Finished Oil Formulation

| COMPONENTS, Wt % | Preferred Range | More Preferred Range | Most Preferred Range |
|---|---|---|---|
| HTHS@150, cP | ≥3.7 | ≥3.1 | ≥2.9 |
| Base Oil viscosity, cSt | ≥2 ≤25 | ≥3 ≤20 | ≥4 ≤16 |
| 300-400 TBN Ca and or Mg Sulfonate | 0.5-7 | 1-5 | 1.5-3 |
| (6000-7000 M. Wt. Succinimide Dispersant) | 0.5-9 | 1-7 | 2-5 |
| (2000-5000 M. Wt. Succinimide Dispersant) | 0.05-10 | 0.1-7 | 0.2-5 |
| Phosphorus from ZDDP, ppm | 300-3000 | 400-2000 | 500-1600 |
| Mo, ppm from Mo antioxidant | 0-1500 | 0-1000 | 0-600 |
| Phenolic Ester based Anti-oxidant | 0-5 | 0-3 | 0-2 |
| Diphenyl Amine based Anti-oxidant | 0-5 | 0-3 | 0-2 |
| (Defoamer) | 0.001-0.5 | 0.005-0.2 | 0.01-0.1 |
| Viscosity Modifier | 0-20 | 0-15 | 0-12 |
| (Pour point depressant) | 0.01-5 | 0.05-2 | 0.1-1.5 |

TABLE 2

Finished Oil Formulation

| COMPONENTS, Wt % | Preferred Range | More Preferred Range | Most Preferred Range |
|---|---|---|---|
| HTHS@150, cP | ≥3.7 | ≥3.1 | ≥2.9 |
| Base Oil viscosity, cSt | ≥2 ≤25 | ≥3 ≤20 | ≥4 ≤16 |
| 200-400 TBN Ca and or Mg Salicylate | 0.5-7 | 1-5 | 1.5-3 |
| (6000-7000 M. Wt. Succinimide Dispersant) | 0.5-9 | 1-7 | 2-5 |
| (2000-5000 M. Wt. Succinimide Dispersant) | 0.05-10 | 0.1-7 | 0.2-6 |
| Phosphorus from ZDDP, ppm | 300-3000 | 400-2000 | 500-1600 |
| Mo, ppm from Mo antioxidant | 0-1500 | 0-1000 | 0-600 |
| Phenolic Ester based Anti-oxidant | 0-5 | 0-3 | 0-2 |
| Diphenyl Amine based Anti-oxidant | 0-5 | 0-3 | 0-2 |
| (Defoamer) | 0.001-0.5 | 0.005-0.2 | 0.01-0.1 |
| Viscosity Modifier | 0-20 | 0-15 | 0-12 |
| (Pour point depressant) | 0.01-5 | 0.05-2 | 0.1-1.5 |

TABLE 3

| Finished Oil Formulation | | | |
|---|---|---|---|
| COMPONENTS, Wt % | Preferred Range | More Preferred Range | Most Preferred Range |
| HTHS@150, cP | ≥3.7 | ≥3.1 | ≥2.9 |
| Base Oil viscosity, cSt | ≥2 ≤25 | ≥3 ≤20 | ≥4 ≤16 |
| 200-400 TBN Ca and or Mg Phenate | 0.5-7 | 1-5 | 1.5-3 |
| (6000-7000 M. Wt. Succinimide Dispersant) | 0.5-9 | 1-7 | 2-5 |
| (2000-5000 M. Wt. Succinimide Dispersant) | 0.05-10 | 0.1-7 | 0.2-6 |
| Phosphorus from ZDDP, ppm | 300-3000 | 400-2000 | 500-1600 |
| Mo, ppm from Mo antioxidant | 0-1500 | 0-1000 | 0-600 |
| Phenolic Ester based Anti-oxidant | 0-5 | 0-3 | 0-2 |
| Diphenyl Amine based Anti-oxidant | 0-5 | 0-3 | 0-2 |
| (Defoamer) | 0.001-0.5 | 0.005-0.2 | 0.01-0.1 |
| Viscosity Modifier | 0-20 | 0-15 | 0-12 |
| (Pour point depressant) | 0.01-5 | 0.05-2 | 0.1-1.5 |

TABLE 4

| Finished Oil Formulation | | | |
|---|---|---|---|
| COMPONENTS, Wt % | Preferred Range | More Preferred Range | Most Preferred Range |
| HTHS@150, cP | ≥3.7 | ≥3.1 | ≥2.9 |
| Base Oil viscosity, cSt | ≥2 ≤25 | ≥3 ≤20 | ≥4 ≤16 |
| 300-400 TBN Ca and or Mg Sulfonate | 0-7 | 0-5 | 0-3 |
| 200-400 TBN Ca and or Mg Salicylate | 0-7 | 0-5 | 0-3 |
| 200-400 TBN Ca and or Mg Phenate | 0-7 | 0-5 | 0-3 |
| (6000-7000 M. Wt. Succinimide Dispersant) | 0.5-9 | 1-7 | 0.2-6 |
| (2000-5000 M. Wt. Succinimide Dispersant) | 0.05-10 | 0.1-7 | 0.2-5 |
| Phosphorus from ZDDP, ppm | 300-3000 | 400-2000 | 500-1600 |
| Mo, ppm from Mo antioxidant | 0-1500 | 0-1000 | 0-600 |
| Phenolic Ester based Anti-oxidant | 0-5 | 0-3 | 0-2 |
| Diphenyl Amine based Anti-oxidant | 0-5 | 0-3 | 0-2 |
| (Defoamer) | 0.001-0.5 | 0.005-0.2 | 0.01-0.1 |
| Viscosity Modifier | 0-20 | 0-15 | 0-12 |
| (Pour point depressant) | 0.01-5 | 0.05-2 | 0.1-1.5 |

EXAMPLES

Example 1

Place 302 g of base oil (150N) into a 1000 ml round bottom flask equipped with stirrer, Dean Stark trap and an addition funnel and add 51 g of Trimethylolpropane poly (oxypropylene)triamine (440 g/mol) and 20 g of 4-Aminodiphenylamine (ADPA), heat the above mixture to 160-170 C. Premix 305 g of PIBSA (PIB Mn2300) and 83 g of dimer acid in a beaker and then mixture is transferred to the addition funnel and slowly added to the flask at 170 C in 1 hr. After completion of the above mixture, raise reaction temperature to 220 C and stay at 220 C for 5 hrs. yield: 754 g, Kv100: 517 cSt, TBN: 4.7 mgKOH/g, nitrogen: 0.94 wt %.

Example 2

Place 275 g of base oil (150N) into a 1000 ml round bottom flask equipped with stirrer, Dean Stark trap and an addition funnel and add 40 g of Trimethylolpropane poly (oxypropylene)triamine (440 g/mol) and 16 g of 4-Aminodiphenylamine (ADPA), heat the above mixture to 160-170 C. Premix 305 g of PIBSA (PIB Mn2300) and 56 g of dimer acid in a beaker and then the mixture is transferred to the addition funnel and slowly added to the flask at 170 C in 1 hr. After completion of the above mixture, raise reaction temperature to 220 C and stay at 220 C for 5 hrs. yield: 688 g, Kv100: 372 cSt, TBN: 4.3 mgKOH/g, nitrogen: 0.91 wt %.

Example 3

Place 260 g of base oil (150N) into a 1000 ml round bottom flask equipped with stirrer, Dean Stark trap and an addition funnel and add 34.6 g of Trimethylolpropane poly (oxypropylene)triamine and 13.6 g of 4-Aminodiphenylamine (ADPA), heat the above mixture to 160-170 C. Premix 305 g of PIBSA (PIB Mn2300) and 42 g of dimer acid in a beaker and then mixture is transferred to the addition funnel and slowly added to the flask at 170 C in 1 hr. After completion of the above mixture, raise reaction temperature to 220 C and stay at 220 C for 5 hrs. yield: 650 g, Kv100: 326 cSt, TBN: 4.2 mgKOH/g, nitrogen: 0.80 wt %.

Example 4

Place 246 g of base oil (150N) into a 1000 ml round bottom flask equipped with stirrer, Dean Stark trap and an addition funnel and add 28.7 g of Trimethylolpropane poly (oxypropylene)triamine (440 g/mol) and 11.4 g of 4-Aminodiphenylamine (ADPA), heat the above mixture to 160-170 C. Premix 305 g of PIBSA (PIB Mn2300) and 28 g of dimer acid in a beaker and then mixture is transferred to the addition funnel and slowly added to the flask at 170 C in 1 hr. After completion of the above mixture, raise reaction temperature to 220 C and stay at 220 C for 5 hrs. Yield: 614 g, Kv100: 311 cSt, TBN: 3.2 mgKOH/g, nitrogen: 0.7 wt %.

Example 5

Place 240 g of base oil (150N) into a 1000 ml round bottom flask equipped with stirrer, Dean Stark trap and an addition funnel and add 24.5 g of Trimethylolpropane poly (oxypropylene)triamine (440 g/mol) and 10.2 g of 4-Aminodiphenylamine (ADPA), heat the above mixture to 160-170 C. Premix 305 g of PIBSA (PIB Mn2300) and 21 g of dimer acid in a beaker and then mixture is transferred to the addition funnel and slowly added to the flask at 170 C in 1 hr. After completion of the above mixture, raise reaction temperature to 220 C and stay at 220 C for 5 hrs. yield: 597 g, Kv100: 305 cSt, TBN: 2.5 mgKOH/g, nitrogen: 0.68 wt %.

Example 6

Place 238 g of base oil (150N) into a 1000 ml round bottom flask equipped with stirrer, Dean Stark trap and an addition funnel and add 30.8 g of Trimethylolpropane poly (oxypropylene)triamine (440 g/mol) and 4.1 g of 4-Aminodiphenylamine (ADPA), heat the above mixture to 160-170 C. Premix 305 g of PIBSA (PIE Mn2300) and 21 g of dimer acid in a beaker and then mixture is transferred to the addition funnel and slowly added to the flask at 170 C in 1 hr. After completion of the above mixture, raise reaction temperature to 220 C and stay at 220 C for 5 hrs. yield: 595 g, Kv100: 335 cSt, TBN: 2.2 mgKOH/g, nitrogen: 0.6 wt %.

Example 7

Bench Test Results for Soot Dispersant Performance

The inventive soot dispersant from example 1 to 6 were blended into a fully formulated HDDE oil which contained conventional dispersant, detergents, ZDDP, antioxidants, viscosity modifier and base oil (table 2)

Above oils were blended with 6 wt % carbon black (Vulcan XC-72) in a beaker with high speed stirrer for 20-30 min, and then evaluated in a rotational rheometer, the rheological measurement of the carbon black containing oils was based on ASTM D-6895. A flow behaviour rate index and rotational viscosity at shear rate of 100 l/s for each oil were reported in the following table. Oils exhibited strong soot handling ability when rate index is close to 1.0 and rotational viscosity is low.

TABLE 5

| Dispersant % | Oil 1 | Oil 2 | Oil 3 | Oil 4 | Oil 5 | Oil 6 | Oil 7 | Oil 8 |
|---|---|---|---|---|---|---|---|---|
| Conventional Dispersant | 4.5 | 1.0 | 1.0 | 1.0 | 1.0 | 1.0 | 1.0 | 2.5 |
| Soot Dispersant Example 1 | | 3.5 | | | | | | |
| Soot Dispersant Example 2 | | | 3.5 | | | | | 2.0 |
| Soot Dispersant Example 3 | | | | 3.5 | | | | |
| Soot Dispersant Example 4 | | | | | 3.5 | | | |
| Soot Dispersant Example 5 | | | | | | 3.5 | | |
| Soot Dispersant Example 6 | | | | | | | 3.5 | |
| Total | 4.5 | 4.5 | 4.5 | 4.5 | 4.5 | 4.5 | 4.5 | 4.5 |
| Rate Index | 0.57 | 0.95 | 0.96 | 0.96 | 0.92 | 0.59 | 0.49 | 0.88 |
| Viscosity at 100 1/s | 69.11 | 20.3 | 21.09 | 20.83 | 21.40 | 61.70 | 79.40 | 28.43 |

As shown in the table 5, the inventive soot dispersants example 1 to 4 exhibited excellent soot handling capability than conventional dispersant.

The invention claimed is:

1. A composition used in an internal combustion engine, the composition comprising a major amount of oil of lubricating viscosity and a minor amount of a dispersant comprising (i) an olefin (ii), a carboxylic acid, (iii) a polyetheramine, and (iv) an aromatic amine, wherein the aromatic amine is a phenylene diamine; and wherein the dispersant has the formula

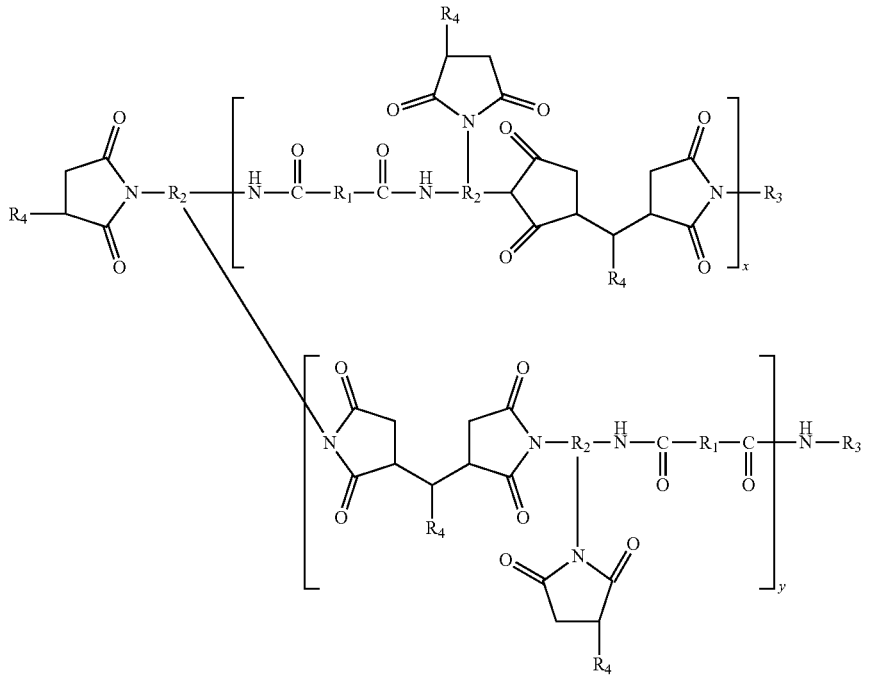

wherein;

$R_1$ is alkyl, alkenyl, alkoxyl, arylalkyl, alkylaryl, or a mixture thereof having from about 20 to 60 carbon atoms;

$R_2$ is alkoxyl or polyether;

$R_3$ is NHaryl (diarylamine);

$R_4$ is polyolefin;

X is 1; and

Y is 1.

2. The composition as claimed in claim 1, wherein the composition further comprises a co-additive selected from the group consisting of a dispersant, a detergent, a zinc dialkyl dithiophosphate (ZDDP), a viscosity modifier, an antioxidant, a defoamant, and a pour point depressant.

3. The composition as claimed in claim 1 wherein, the olefin is a polyisobutylene succinic anhydride having a Mn from 500 to 3500.

4. The composition as claimed in claim 1 wherein, the carboxylic acid is a dimer acid or trimer acid having a Mn from 100-2000, or mixture of thereof.

5. The composition as claimed in claim 4 wherein, the dimer acid or trimer acid has from about 30-60 carbon atoms.

6. The composition as claimed in claim 1 wherein, the polyetheramine is a triamine having a Mn from 300-5000, and wherein the triamine consists of primary and secondary amines.

7. The composition as claimed in claim 1 wherein, the aromatic amine is an amine selected from the group consisting of N-phenyl-1,4-phenylenediamine, N-phenyl-1,3-phenylendiamine, and N-phenyl-1,2-phenylenediamine, and amino-di-phenylamine or a mixture of thereof.

8. The composition as claimed in claim 2 wherein, the detergent is an oil-soluble overbased metal detergent selected from the group consisting of sulfonate, salicylate, and phenate or a mixture thereof having a total base number (TBN) greater than 200 present in a range of 1.5-3% w/w.

9. The composition as claimed in claim 2, wherein the ZDDP is present in a range of 1.5-2% w/w.

10. The composition as claimed in claim 9, wherein the alkyl group present in ZDDP has the same or different hydrocarbyl radicals having from about 2-18 carbon atoms.

11. The composition as claimed in claim 2, wherein the antioxidant is selected from the group consisting of molybdenum based antioxidant, phenolic ester based antioxidant, and diphenyl amine based anti-oxidant or a mixture thereof.

12. The composition as claimed in claim 11, wherein the antioxidant is present in a range of 0-2% w/w.

13. The composition as claimed in claim 2, wherein the said defoamer is present in a range of 0-1% w/w.

14. The composition as claimed in claim 2, wherein the said viscosity modifier is present in a range of 7-9% w/w.

15. The composition as claimed in claim 2, wherein the said pour point depressant is present in a range of 0-2% w/w.

16. The composition of claim 1, wherein the internal combustion engine is a diesel engine.

17. The diesel engine of claim 16, wherein the diesel engine is a heavy duty diesel engine.

18. The composition of claim 1, wherein the polyolefin is Polyisobutylene.

19. The composition of claim 6, wherein the polyetheramine is amine terminated polyether of polyethylene oxide (PEO), polypropylene oxide (PPO), or a mixture thereof.

* * * * *